US008602073B2

(12) United States Patent
Swain

(10) Patent No.: US 8,602,073 B2
(45) Date of Patent: Dec. 10, 2013

(54) MULTI-USE CONVERTIBLE FOREARM PURSE

(76) Inventor: Tammy L Swain, Stockbridge, GA (US)

( * ) Notice: Subject to any disclaimer, the term of this patent is extended or adjusted under 35 U.S.C. 154(b) by 491 days.

(21) Appl. No.: 12/930,803

(22) Filed: Jan. 18, 2011

(65) Prior Publication Data

US 2012/0180916 A1 Jul. 19, 2012

(51) Int. Cl.
*A41D 13/08* (2006.01)

(52) U.S. Cl.
USPC ..... 150/106; 2/16; 2/59; 224/219; 224/223

(58) Field of Classification Search
USPC ..... 2/16, 59; 224/219, 223; 150/106
See application file for complete search history.

(56) References Cited

U.S. PATENT DOCUMENTS

| | | | | |
|---|---|---|---|---|
| 2,459,992 | A * | 1/1949 | Cimino | 224/222 |
| 2,881,441 | A * | 4/1959 | Bass | 2/1 |
| 3,189,073 | A * | 6/1965 | Todd | 224/222 |
| 3,942,693 | A | 3/1976 | Tocci | |
| 4,510,928 | A * | 4/1985 | Ackley | 602/4 |
| 4,622,961 | A * | 11/1986 | Christensen | 602/4 |
| 4,759,353 | A * | 7/1988 | Melendez et al. | 602/4 |
| 5,009,347 | A | 4/1991 | Phelps | |
| 5,357,633 | A * | 10/1994 | Rael | 2/16 |
| 5,909,801 | A * | 6/1999 | Coffman | 2/16 |
| 6,092,235 | A * | 7/2000 | Santa Cruz et al. | 2/16 |
| 6,443,341 | B1 | 9/2002 | Rittmann | |
| 2003/0057240 | A1 | 3/2003 | Johnson | |
| 2004/0250933 | A1 | 12/2004 | DeMichele | |
| 2006/0248624 | A1 * | 11/2006 | Pieczynski | 2/16 |
| 2007/0095871 | A1 | 5/2007 | Chen | |
| 2009/0000002 | A1 * | 1/2009 | Hadash | 2/16 |
| 2009/0199939 | A1 | 8/2009 | Pruzhansky | |

* cited by examiner

*Primary Examiner* — Tri Mai
(74) *Attorney, Agent, or Firm* — J.T. Hollin, Jr. Attorney at Law

(57) ABSTRACT

Disclosed is a convertible forearm purse which can be securely worn on the forearm of the user, or which, alternatively, may be carried, by means of a strap, in a different configuration as a shoulder bag. The convertible forearm purse attaches to wearer's forearm by a tubular opening that accommodates insertion of the hand and forearm and by smaller openings which facilitate hooking to the thumb, fingers, and the lower part of the wearer's palm. The convertible forearm purse extends over the wrist, upward to the forearm, and continues in length, stopping just short of the elbow. The forearm purse comprises at least one zipper or other means for accessing an internal compartment, a storage compartment for the shoulder strap, an interiorly-contained wallet, and further includes a pair of closeable exterior pockets.

4 Claims, 4 Drawing Sheets

MULTI-USE CONVERTIBLE FOREARM PURSE

REFERENCE TO RELATED APPLICATION

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

The inventive concept presented herein generally relates to a multi-use forearm purse that may be converted to a shoulder bag. Users can attest to the fact that carrying a purse can make a fashion statement, or provide utilitarian functions, but can also become highly inconvenient. The forearm purse disclosed herein offers the user a safe and convenient way of carrying the most important items that are normally placed in a purse or wallet, such as cash, credit cards, identification cards, cosmetic items, and other necessities. A variety of styles, designs, and colors can easily provide an enhanced, fashionable look.

The forearm purse securely attaches to the user's forearm and leaves the user's hands free for the physical maneuverability required for activities such as child care, shopping, social activities, and carrying bulky objects.

(2) Description of the Related Art

The inventor in U.S. Pat. No. 3,942,693 (1976) disclosed a device employing a wrist purse slidably secured to the arm of a wearer, the purse being normally hidden under the sleeve of a garment worn by the wearer. The purse has a hidden position except when the purse is pulled along the arm and the wrist and is held momentarily exposed for use.

U.S. Pat. No. 5,009,347 (1991) features a wrist holster including a wristband, a transversely extending pouch for accommodating a canister for a protective gas, a fold-back closure for the pouch secured by a pressure sensitive fastener, an extended strap at one end of the wristband, and a buckle carried by the end of the wristband opposite the extended strap.

A wrist wallet is disclosed in U.S. Pat. No. 6,443,341 B1 (2002), which is substantially made of mesh fabric, having laterally positioned first pocket, second pocket, and third pocket. A lining is inside the third pocket. All pockets have a single laterally elongated sealing element at the top of the wallet in the form of a zipper having teeth. The wallet is secured circumferentially about a wearer's wrist.

US patent application publication 2003/0057240 (2003) discloses a purse which is worn on the hand, having a top side and a bottom side, a top end portion and a bottom end portion. The purse has a pouch portion with an access opening on top of the purse. A strap is operably secured to the purse and is positioned at the top end portion of the purse. A loop is operable secured to the bottom end and may be looped around a finger to secure and position the purse.

A wrist cover in which to carry a cell phone is presented in US patent application publication #US 2007/0095871 A1 (2007). Shown is a body, a phone holder and an adjusting device. The body has a ventilating layer and two wrist wings. The phone holder is attached to the body and has a covering sheet and a connecting tab. The covering sheet is attached to the ventilating layer and defines a holding space between the covering sheet and the ventilating layer and an opening.

US patent application publication #US 2009/0199939 (2009) discloses a purse system for holding personal items of a user on the user's wrist, or conventionally. The device is comprised of a front section and a rear section, each section being pivotally fixed together at a common lower edge. At least one wrist band is included, having a band closure and attachable around the wrist of the user and secured thereto with the band closure. A shoulder strap is further included and attachable at each end thereof to one of a pair of strap attachment means fixed to the purse.

BRIEF SUMMARY OF THE INVENTIVE CONCEPT

The inventive concept herein discloses a tubular-shaped forearm purse which can be securely worn on the forearm of a user or, it may be carried in a different configuration as a shoulder bag. The forearm purse is donned by the user inserting his/her hand through a circular opening, designated as the forearm section. Continuing on through the length of the forearm purse, there are two smaller openings in the glove section of the purse, designed to accommodate the insertion of the wearer's thumb and remaining four fingers.

After complete insertion of the user's complete arm, the glove section of the forearm purse facilitates securement of the thumb and the lower part of the wearer's palm. A sheath, comprising the predominant length of the forearm purse, then extends over the wrist, upward to the forearm, and continues in length, stopping just short of the elbow. The forearm purse may further comprise at least one zipper for opening and closing a sheath interior access, an internal fastening mechanism for retaining a compatible wallet, a detachable shoulder strap, and it further includes a plurality of exterior closeable pockets.

BRIEF DESCRIPTION OF THE VIEWS OF THE DRAWINGS

The objects, features, and advantages of the concept presented in this application are more readily understood when referring to the accompanying drawings. The drawings, totaling seven figures, show the basic functions of various embodiments and methods. In the several figures, like reference numbers are used in each figure to correspond to the same component as may be depicted in other figures.

FIG. 4 exhibits the sheath of the forearm purse with the zipper open, while FIGS. 4*a* and 4*b* present a view of the first and second outer pockets.

FIG. 6 is the backside of the removable wallet.

FIG. 7 illustrates the front side of the removable wallet.

FIG. 8 displays the shoulder strap in the coiled configuration, in preparation for storage.

Table of Nomenclature For Components

| | |
|---|---|
| 1. | Forearm purse |
| 2. | Hooking mechanism |
| 3. | Hooking adjustment |
| 4. | Sheath |
| 5. | Zipper bed |
| 6. | Lining |
| 7. | First outer pocket |
| 8. | Second outer pocket |
| 9. | Lower clasp |
| 10. | Top clasp |
| 11. | Lower fastener |
| 12. | Top fastener |
| 13. | Shoulder strap |
| 14. | Strap compartment |
| 15. | Inseam hook component |
| 16. | Inseam loop component |
| 17. | Pocket flap 1 |
| 18. | Pocket flap 2 |
| 19. | Wallet front |
| 20. | Wallet backside |
| 21. | Zipper chain |
| 22. | Zipper pull tab |
| 23. | Zipper slider |
| 24. | Main zipper |
| 25. | Glove section |
| 26. | Arm opening |
| 27. | Thumb opening |
| 28. | Fingers opening |
| 29. | Elastic forearm panel |
| 30. | Sheath opening |
| 31. | Web area |
| 32. | n/a |
| 33. | Wallet hook component |
| 34. | Sheath loop component |
| 35. | n/a |
| 36. | Forearm section |
| 37. | Wristband section |
| 38. | Sheath interior access |
| 39. | Male snap |
| 40. | Female snap |
| 41. | Adjustment tab |
| 42. | Tab female snap |
| 43. | Tab male snap |

DETAILED DESCRIPTION OF THE INVENTIVE CONCEPT

Figure 1:
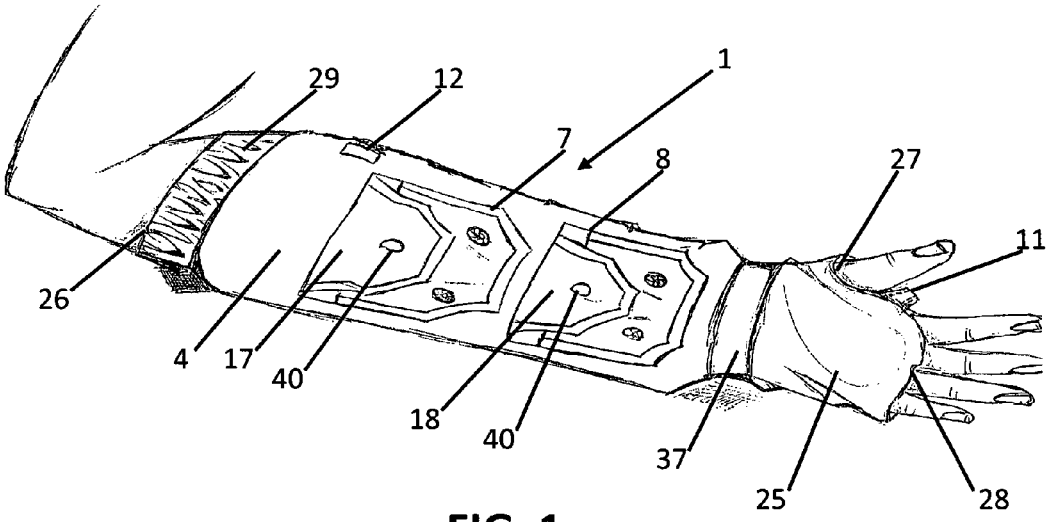
FIG. 1 displays the forearm purse on the arm of a wearer.

In viewing FIG. 1, the overall function, orientation, and features of the forearm purse 1 are shown. The forearm purse 1, as shown, is basically a tubular structure designed primarily to be worn on a wearer's forearm. Different sections of the forearm purse 1 are progressively accessed through an arm opening 26, a thumb opening 27, and a fingers opening 28. In FIG. 1, the forearm purse 1 is oriented horizontally, with an integral strap 13 deployed. The shoulder strap 13 may be stowed within a special strap compartment 14 (not shown) which compartment is accessed by a main zipper 24 which is attached to the sheath 4 of the forearm purse 1 by means of a zipper bed 5 co-located with a lengthwise sheath interior access 38 opening in the sheath 4.

The sheath 4 may be constructed of any of several different materials, including, but not limited to leather, vinyl, plastic, cotton, denim, synthetic fabrics, canvas. Further, any one of the previously mentioned materials may be fabricated in a mesh-like structure to enhance ventilation of the wearer's arm and forearm. When the strap 13 is stowed, a wearer dons the forearm purse 1 by placing his/her hand through an arm opening 26 bordered by an elastic panel 29, and continuing the hand on through the length of the interior of the forearm purse 1 until the wearer's thumb emerges at the thumb opening 27 and the wearer's fingers project through the fingers opening 28. The forearm purse 1 is designed with convenient features and integral accessories.

Figure 4:
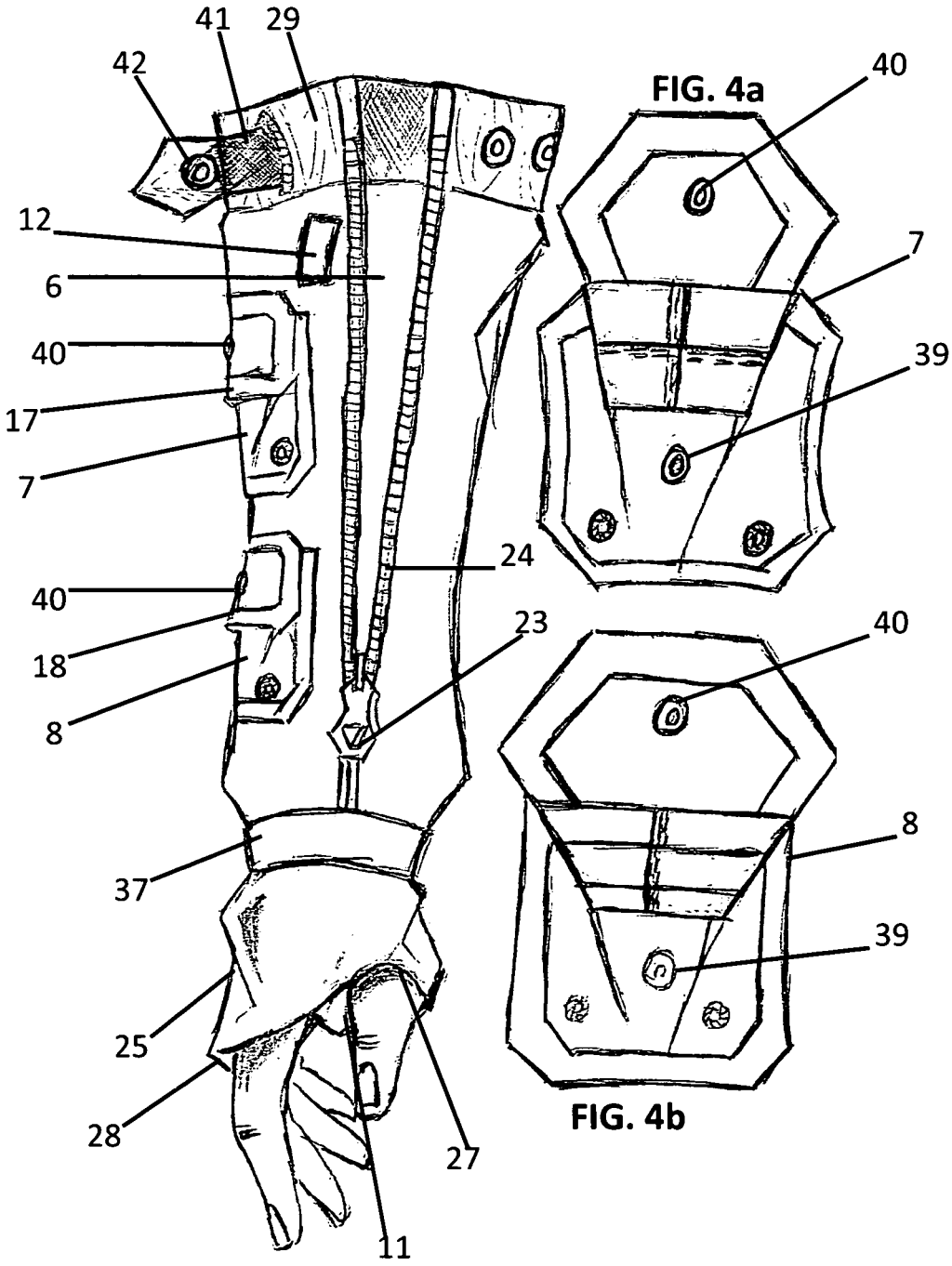

FIG. 4 depicts an exploded view of the forearm purse 1 fitted with a first outer pocket 7 and a second outer pocket 8. Both outer pockets, 7 and 8, are shown in FIGS. 4*a* and 4*b*, respectively. The outer pockets 7, 8, are secured to the sheath 4 by stitching the perimeter of the outer pockets 7, 8, onto the outer surface of the sheath 4. Any contents of either outer pocket 7, 8, are kept safely enclosed by means of pocket flaps 17, 18, identically located on each respective outer pocket 7, 8. In the embodiment shown in FIGS. 4*a* and 4*b* a pocket flap 1 17, and a pocket flap 2 18 each may be securely closed by pressing a male snap 39 and a female snap 40 together when either pocket flap 17, 18 is closed. The first and second outer pockets 7, 8 may also be closed by other suitable means, including, but not limited to, zippers hook-and-loop devices, buttons, magnets, and "zip-loc" type mechanisms. For illustrative purposes only, the present inventive concept is depicted using snaps 39, 40 as the closing mechanism for pocket flap 1 17 and pocket flap 2 18.

Figure 2:
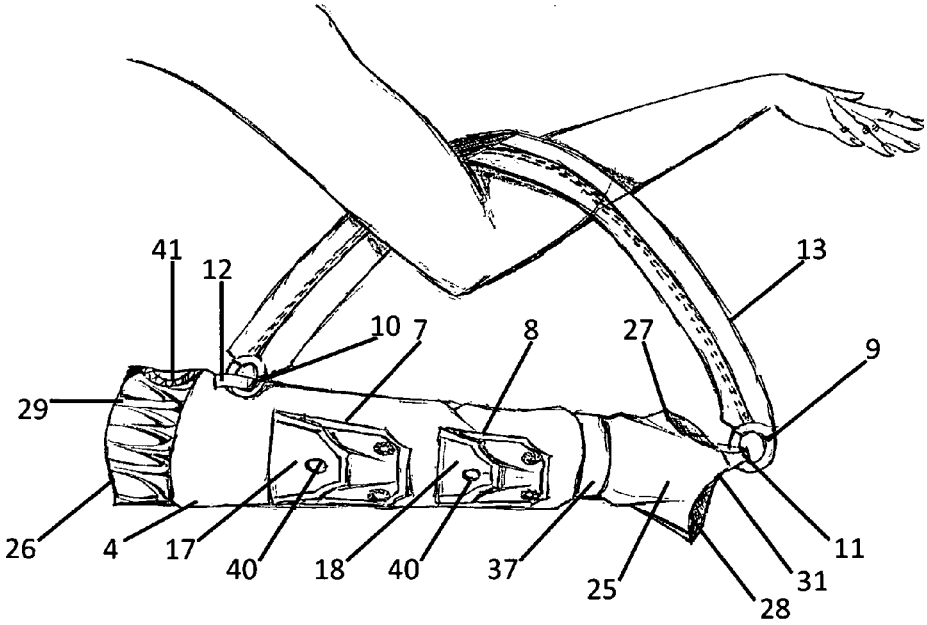
FIG. 2 displays the forearm purse carried by a wearer using the shoulder strap.

At the wearer's discretion, the forearm purse 1 may be worn on the shoulder by utilizing the optional strap 13, or for carrying in the crook of the wearer's arm, as shown in FIG. 2. In its preferred embodiment, the strap 13 further comprises an openable circular lower clasp 9 and an openable circular top clasp 10 affixed to opposite ends of the strap 13. Each circular clasp 9, 10, depending on the orientation of the strap 13 when removed from the strap compartment 14, may be connected to either a lower fastener 11, which is affixed to the glove section 25 of the forearm purse 1 or to a top fastener 12, which is affixed to the upper section of the sheath 4.

Figure 5:
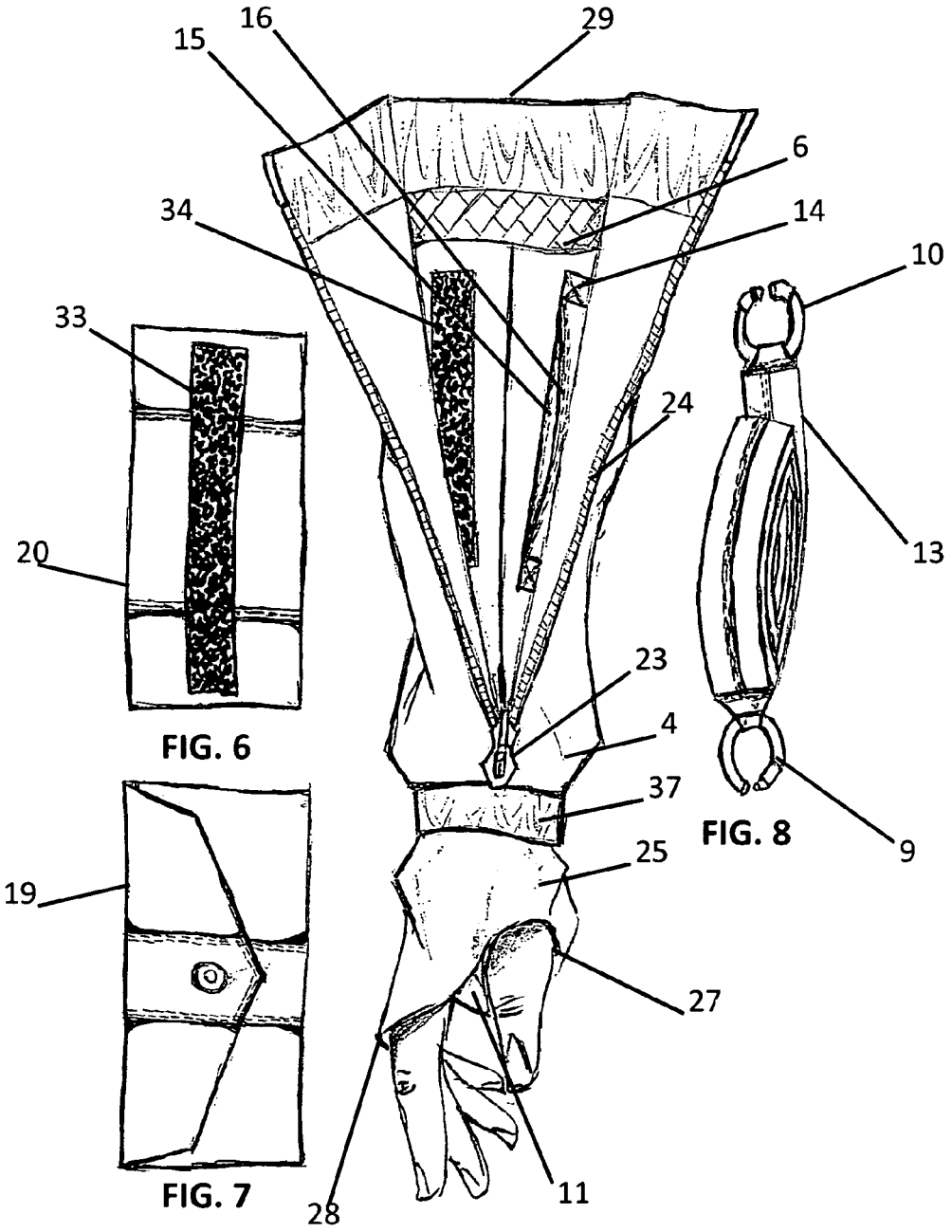
FIG. 5 displays a basic embodiment with the sheath interior access unzipped.

The strap 13, normally stowed in the strap compartment 14 is accessed, as shown in FIG. 5, by unzipping the main zipper 24 and opening the sheath interior access 28, thereby exposing the strap compartment 14. The strap compartment 14 is an opening within the sheath's lining 6 which is an inseam that may be fastened by means of a hook-and-loop fastening mechanism. The hook-and-loop mechanism, as shown in FIG. 5, consists of an inseam hook component 15 and an inseam loop component 16. By pulling apart the inseam hook and loop components 15, 16, the shoulder strap 13 may then be removed from the strap compartment 14.

In viewing FIGS. 5-8, when considering preparations prior to using the forearm purse 1, the wearer may have a need to add or re-arrange items in an optional interior wallet, of which the wallet front 19 and the wallet backside 20 are shown in FIG. 7 and FIG. 6, respectively. The wallet 19, 20 is retained interiorly to the forearm purse 1 by means of a hook and loop fastening mechanism 33, 34. In referring to FIG. 5 and FIG. 6, it is seen that a wallet hook component 33 of this fastening mechanism is affixed to the wallet backside 20, while a sheath loop component 34 of the fastening mechanism is affixed to the interior lining 6 of the forearm purse 1. After each removal of the wallet 19, 20 the wearer aligns the wallet hook component 33 with the sheath loop component 34 and presses both components together to effect securement and storage of the wallet 19, 20 within the forearm purse 1.

The forearm purse 1 may be manufactured in a variety of sizes to accommodate different physical sizes of potential users. Further, the elastic forearm panel 29 is sufficiently expandable to comfortably encompass the forearm of a user. The wrist section 37 of the forearm purse 1 is also flexible so as to allow insertion of the user's hand while donning the forearm purse 1. In referring to FIG. 3, an exploded view of a basic embodiment of the forearm purse 1 is shown. To provide for a greater range of size openings for the elastic forearm panel 29, an adjustment tab 41 is sewn to the exterior of the elastic forearm panel 29. The adjustment tab 41 may be positioned at two different locations on the elastic forearm panel 29 by means of a female snap 42 integral to the adjustment tab 41. Two male snaps 43 sewn onto spaced apart locations on the elastic forearm panel 29 permit the joining of the female snap 42 at either of the spaced apart locations, thereby adjusting the size of the opening of the elastic forearm panel 29.

Figure 3:
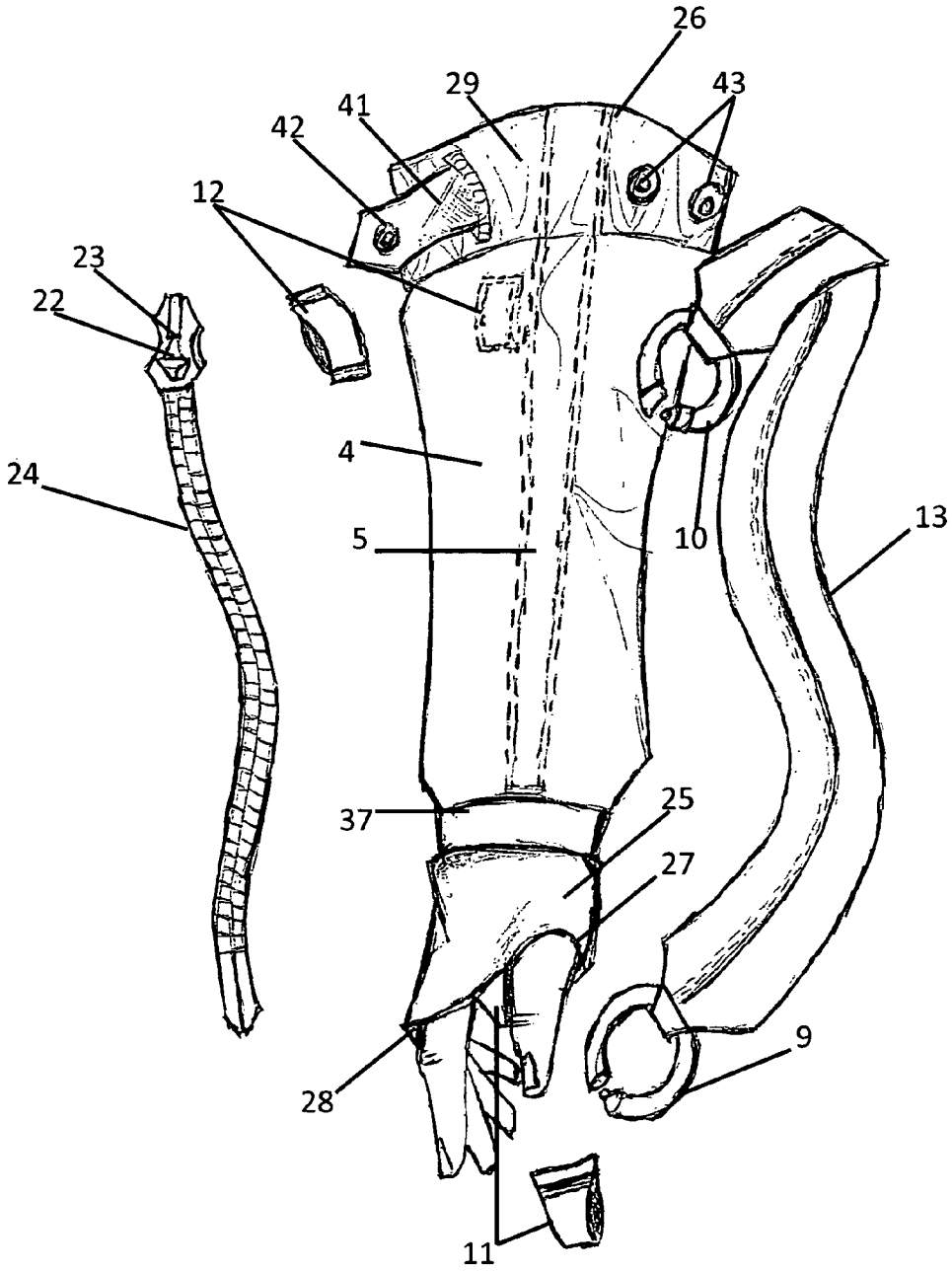
FIG. 3 presents an exploded comprehensive view of the basic embodiment of the inventive concept, with the optional shoulder strap.

Also shown in FIG. 3 is the lower fastener 11 and its projected location, the top fastener 12 and its projected location, a zipper bed 5, which locates the longitudinal positioning of a zipper assembly, which assembly includes the main zipper 24, a zipper slider 23, and a zipper pull tab 22.

While preferred embodiments of the present inventive concept have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, and by no means limited by the scope of the claims presented herein.

What is claimed is:

1. A tubular-shaped, convertible forearm purse comprising a glove section, a wristband section, a sheath, a sheath lining, a sheath interior access, a means for opening and closing said sheath interior access, an elastic forearm panel, a first exterior pocket having a means for closing and opening said pocket, a second exterior pocket having a means for closing and opening said pocket, a wallet, a means for removably attaching said wallet to the interior surface of said sheath, a strap, a strap compartment, and a means for attaching said strap to said forearm purse, wherein an overall tubular structure is fabricated by sequential attachment of the glove section, wristband section, sheath, and elastic forearm panel, in that order.

2. A tubular-shaped, convertible forearm purse as in claim 1, wherein the means for opening and closing said sheath interior access comprises a zipper assembly;

the means for opening and closing said first exterior pocket and said second exterior pocket comprise male snap and a female snap attached to a foldable flap;

the means for removably attaching said wallet to the interior surface of said sheath comprises a hook and loop fastening mechanism;

the means for attaching said strap to said forearm purse comprise an openable circular clasp attached to each end of said strap, a hooped lower fastener attached to said glove section, and a hooped top fastener attached to said elastic forearm panel, whereby either openable clasp of said strap may be attached to the hooped lower fastener or the hooped top fastener,

3. A tubular-shaped, convertible forearm purse comprising a thumb opening, a fingers opening, a glove section, a wristband section, a sheath, a sheath lining, a sheath interior access, a means for opening and closing said sheath interior access, an elastic forearm panel, an adjustment tab, a means for positioning said adjustment tab, a first exterior pocket having, a means for closing and opening said pocket, a second exterior pocket having a means for closing and opening said pocket, a wallet, a means for removably attaching said wallet to the interior surface of said sheath, a strap, a strap compartment, and a means for attaching said strap to said forearm purse, wherein an overall tubular structure is fabricated by sequential attachment of the glove section, wristband section, sheath, and elastic forearm panel, in that order.

4. A tubular-shaped, convertible forearm purse as in claim 3, wherein the means for opening and closing said sheath interior access comprises a zipper assembly;

the means for opening and closing said first exterior pocket and said second exterior pocket comprise male snap and a female snap attached to a foldable flap;

the means for removably attaching said wallet to the interior surface of said sheath comprises a hook and loop fastening mechanism;

the means for attaching said strap to said forearm purse comprise an openable circular clasp attached to each end of said strap, a hooped lower fastener attached to said glove section, and a hooped top fastener attached to said elastic forearm panel, whereby either openable clasp of said strap may be attached to the hooped lower fastener or the hooped top fastener.

* * * * *